United States Patent [19]

Aho

[11] Patent Number: 4,538,365

[45] Date of Patent: Sep. 3, 1985

[54] HORIZONTAL DRIP DRYER

[76] Inventor: Martin P. Aho, P.O. Box 6333, Oakland, Calif. 94603

[21] Appl. No.: 635,188

[22] Filed: Jul. 27, 1984

[51] Int. Cl.[3] ..... F26B 9/10

[52] U.S. Cl. ..... 34/239; 211/195; 211/200

[58] Field of Search ..... 211/195, 200; 297/45; 34/239, 240

[56] References Cited

U.S. PATENT DOCUMENTS

| | | | |
|---|---|---|---|
| 2,084,854 | 6/1937 | Mc Carthy | 211/195 |
| 3,675,338 | 7/1972 | Maki | 34/239 |
| 4,325,577 | 4/1982 | Thebaud | 297/45 |

FOREIGN PATENT DOCUMENTS

| | | | |
|---|---|---|---|
| 237369 | 8/1945 | Switzerland | 211/178 |

OTHER PUBLICATIONS

Modern Plastics, Jun. 1984, p. 88, Folding Director's Chair.

*Primary Examiner*—Larry I. Schwartz
*Attorney, Agent, or Firm*—Henry H. Johnson

[57] ABSTRACT

A dryer for drip dry type of clothing. The dryer has a horizontal screen, on which clothing to be dried can be placed, supported by two parallel rails, which are fastened to the tops of two pair of legs which have pivots to permit the dryer to be folded into a compact storage position. When in use, the area bounded by the feet is much smaller, about 40 percent of the width and 50 percent of the length, than the area of the screen.

As a fraction of the length of the leg from the bottom of the leg, the pivots are about one fourth and the leg bend, inward about 30 degrees, starts at about one third. This makes the dryer low in height when used, and makes the angle the legs make with the screen small, so screen tension increases with load keeping the screen quite flat. When the dryer is stored, the location of the pivots and the bend of the legs provides clearance so the screen is not squeezed. The feet are spaced apart in the stored position so the dryer can be stored upright. The dryer can be secured in the stored position by resilient bands that hold together the tops of each pair of legs. For very heavy clothing, two slats separating the rails to make the screen flatter, can be used.

11 Claims, 4 Drawing Figures

HORIZONTAL DRIP DRYER

FIELD OF THE INVENTION

This invention relates generally to a dryer which has a relatively large, low, horizontal surface for drying drip dry type of clothing and folds quickly, easily and compactly for storage.

BACKGROUND ART

Some dryers have about four times the height of this dryer, so for the same horizontal drying area, this dryer takes up only about one fourth of the volume when in use. This dryer with its low height, good clearance under both sides and ends and with its feet in a small area, makes it convenient to use on a usually unused top of a washer or dryer. The low height also makes it quite convenient to work on when the dryer is placed on the floor. After use, this dryer can be put into a compact, stored position by folding, and simple fastening and if desired by putting on a dust cover.

Prior Art also includes the folding camp stool with a flexible seat. When in use, the area bounded by the legs is about equal to the area of the seat. The angle between the plane of the seat and the plane of a pair of parallel legs of a camp stool when in use is larger than the comparable angle on the dryer. The seat of the camp stool generally is not supposed to be flat. It is more comfortable if it conforms somewhat to the load, but the screen of the dryer should be quite flat when loaded.

SUMMARY OF THE INVENTION

An object of this invention is to provide a horizontal dryer for drip dry type of clothing that is compact in use as well as in storage, and is easy to change from one position to the other.

Another object is to provide a horizontal dryer that is simple to use and especially suited to quickly dry clothing that has been through a machine delicate drying cycle or has been partially hand dried.

Another object is to provide a dryer which is easy to use, has a large drying area for its size and can be made at low cost.

DESCRIPTION OF THE PREFERRED EMBODIMENTS

Figure 1:
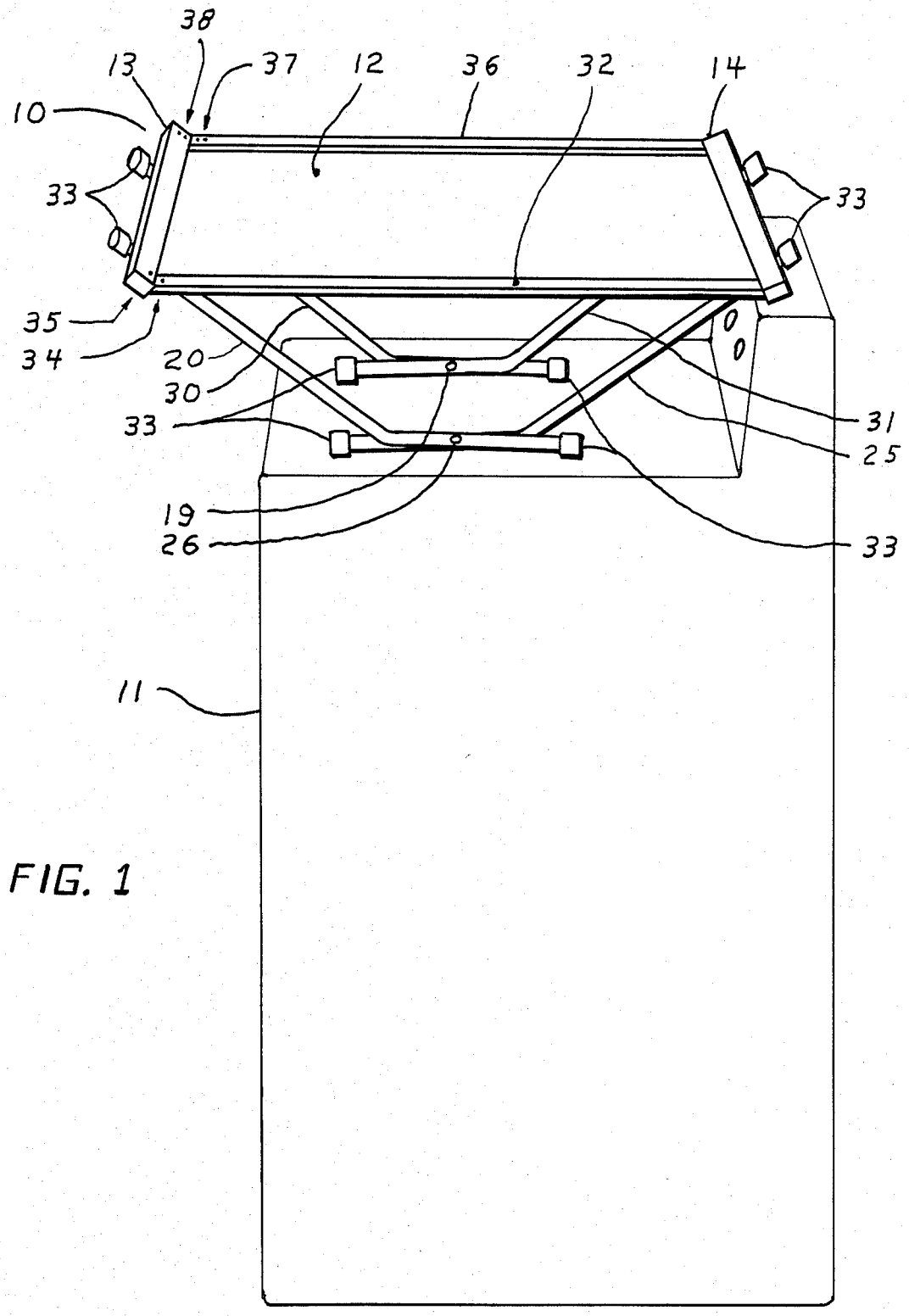
FIG. 1 is a perspective view of the dryer.
Figure 2:
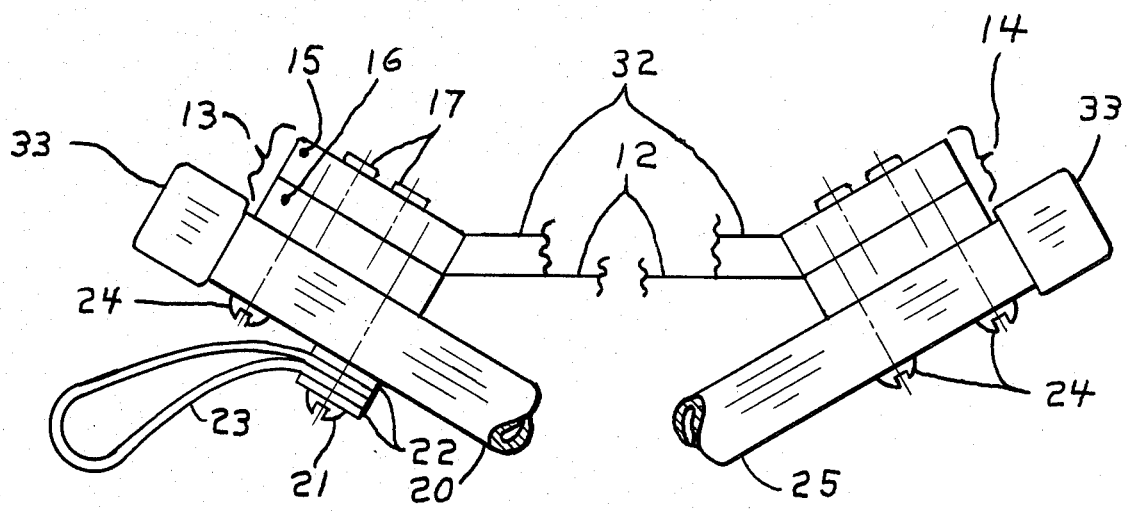
FIG. 2 is a partial end elevation view.
Figure 3:
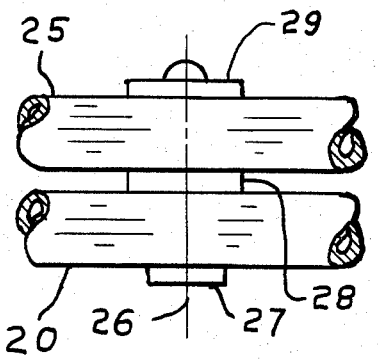
FIG. 3 is a plan view of a pivot.

In FIG. 1, the numeral 10 represents the dryer on a clothes washer 11. Screen 12, can be made from stainless steel, aluminum, nylon or other material and in screen, perforated, or other form, but should stretch little with tension and be quite open and quite flexible like the preferred fiberglass insect screen with a 18×16 mesh (about 7.1×6.3 strands/cm). Screen 12 can be fastened by stapling or other means along the length of rails 13 and 14. Rails 13 and 14 are parallel and have their ends even. Rail 13, see FIG. 2, is made up of two pieces of wood 15 and 16, that hold screen 12 between them by nails 17. Rails 13 and 14 can be made of one or more pieces of plastic, metal or other material in molded, extruded or other forms. Rail 13 is fastened to leg 20, with the top of the rail about 1.5 cm from the top of the leg, by lower wood screw 21, which goes through two washers 22, with elastic band 23 between them, through leg 20 and part 16 and is screwed into part 15. Rail 13 is also held by screw 24 to leg 20. Rail 14 is fastened to leg 25 by two screws 24. Leg 20 and leg 25 form a pair which has a pivot 26, see FIG. 3, made up of a rivet 27, a washer 28 between the legs and a washer 29 under the riveted end, holding the legs together. Rail 13 and a second elastic band 23 are fastened to leg 30 the same way as to leg 20. Rail 14, see FIG. 1, is fastened to leg 31 the same way as to leg 25. Legs 30 and 31 form a pair and have a pivot 19 holding them together. One end cap 33 is put on each end of the four legs to make; the bottom ends of the legs suitable for feet in the two positions, see FIGS. 1 and 4, and the top ends of the legs safer and all of the leg ends look better.

Figure 4:
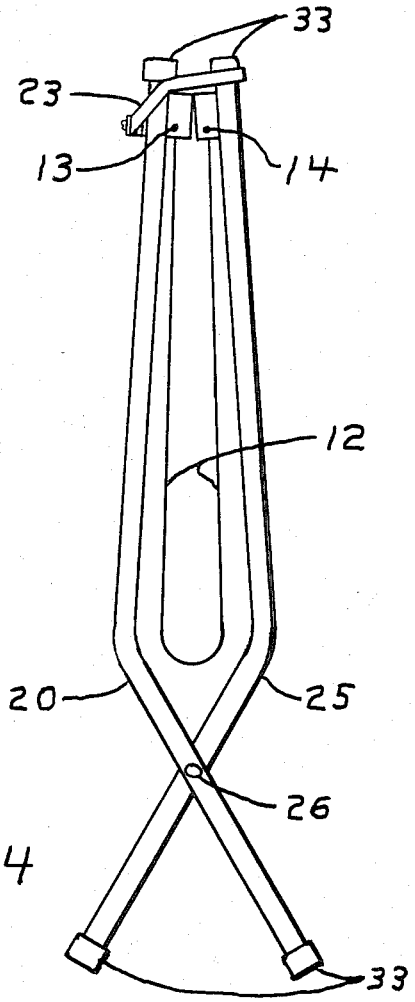
FIG. 4 is an end elevation view of the dryer in the stored position.

The preferred, nominal size, with no tolerance limits, for home use is a dryer; in the stored position, see FIG. 4, 15 cm wide, 91 cm long and 60 cm high; and in the in-use position, see FIG. 1, with a drying area 71 cm wide and 91 cm long, and a height of 22 cm. The dryer is low, in the in-use position, when both pair of legs have their pivots in the low position, which is about 0.7 times the leg diameter, above the surface the dryer rests on. The more the low position is below about 0.6, the more the risk of having the legs touch the surface the dryer rests on and the more the low position is above about 0.8, the worse the legs look and the more complicated the bending of the legs becomes and/or the greater the height the dryer becomes.

The approximate dimensions of the legs, as a percent of the way along the unbent leg from the bottom end is; a pivot at 23, a leg angle bend of about 30 degrees, with about a 6 cm radius, starting at 33, and the rail holes located so that the top of the rail is about 1.5 cm from the leg top. As the leg angle gets smaller, the tension on screen 12 gets greater with a given load and screen 12 gets flatter, and the dryer will get lower, and the clearance under the screen will get smaller. The location of the pivots, and the way the legs are bent, provide clearance so as to not squeeze screen 12, see FIG. 4, and space the feet apart to make the dryer stable in the stored position. As an approximate percentage of the way toward the bottom from the tops of the legs; the pivots are 80, the greatest width of the screen is 62, the bottom of the screen is 66, the widest spacing of the legs above the pivot is 66. The area bounded by the dryer feet in the in-use position is determined partly by the distance, expressed as a percentage of the rail length, each pair of legs is placed from the nearest rail end. As this percentage gets smaller, the dryer stability and area taken by the feet, both increase. While this percentage can vary from 0 to around 38, a good compromise is at about 25. The area is also determined by the width of the feet. A good compromise is when the width of the feet is about 40 percent of the screen width. The width of the feet in the in-use position can be increased by making the legs longer from the pivot to the foot end, but this will also increase the height of the dryer in the stored position, see FIG. 4.

The dryer can be secured in the stored position by putting elastic bands 23 over legs 25 and 31, or by using one or more latches or other means.

The dryer, see FIG. 1, dries quickly because air can easily get under, over and through screen 12.

For heavier drip dry clothing than normal, see FIG. 1, slat 32 is snugly fitted between rails 13 and 14 at one end of the dryer and has a witness mark, 34 with arrow, at one end to match a witness mark 35 on rail 13. Slat 36 is similiarly fitted at the other end of rails 13 and 14, with a second witness mark 37 matching witness mark 38 on rail 13. Means to hold the slats 32 and 36 in place between rails 13 and 14 are used, like an acute end angle, see FIG. 2, at the ends of each slat fitted into a mating angle on the rails.

The screen should be kept clean by a dust proof storage place or by a cover that extends down past the screen in the stored position.

It is to be understood that many of the dimensions, materials and other information given for the purpose of illustration, may be varied considerably by those in the art without departing from the spirit and scope of my invention.

I claim:

1. A dryer for drip-dry type of clothing that can be put into an in-use position and folded into a stored position, comprising:

a screen;

a first rail and a second rail; fastened to the screen on opposite sides;

a first pair of legs and a second pair of legs; each pair of legs having; one end of one leg fastened to the first rail and one end of the other leg fastened to the second rail, and the other ends of the legs of each pair acting as feet;

two pivots; each pair of legs having a pivot so that the dryer can be folded into the stored position from the in-use position, with each pivot located at a place along the length of the legs and each leg bent to make the feet wide enough in both the in-use position and the stored position to make the dryer stable in both positions.

2. The dryer as in claim 1: with the first pair of legs fastened to the rails at a distance of between 5 and 38 percent of the length of the first rail from one end of the first rail and the second pair of legs fastened to the rails at a distance of between 5 and 38 percent of the length of the first rail from the other end of the first rail.

3. A dryer for drip-dry type of clothing having an in-use position and a stored position, comprising:

a screen;

a first rail and a second rail; fastened to the screen on opposite sides;

a first and a second pair of legs; each pair of legs having; one end of one leg fastened to the first rail and one end of the other leg fastened to the second rail, and the other ends of the legs acting as feet;

two pivots; each pair of legs having a pivot so that the dryer can be folded from the in-use position to the stored position, and each leg having, as a percentage of the length of that leg from the bottom of that leg, a leg angle bend starting at between 28 and 47 percent, with each pivot located at less than 35 percent and closer to the bottom of the leg than the start of the leg angle bend and with the leg angle bend made between 10 and 40 degrees.

4. The dryer as in claim 3: with the first and second rails made substantially equal in length and with the first pair of legs fastened to the rails at a distance of between 5 and 38 percent of the length of the rails from one end of the rails and the second pair of legs fastened to the rails at a distance of between 5 and 38 percent of the length of the rails from the other end of the rails.

5. The dryer as in claim 4: with the screen having all dimensions of its openings less than 5 cm.

6. A dryer for drip-dry clothing that can be placed into an in-use position or a stored position, comprising:

a screen;

two rails; with the first rail fastened to the screen on one side and the second rail fastened to the screen on the opposite side;

a first and a second pair of legs; each pair of legs having; one end of one leg fastened to the first rail and one end of the other leg fastened to the second rail, and the other ends of the legs acting as feet;

two pivots; each pair of legs having a pivot so that the dryer can be folded from the in-use position to the stored position, with each pivot located at a place along the length of the legs and each leg bent so that the legs clear the screen when the dryer is in the stored position, with the first pair of legs fastened to the rails at a distance of between 5 and 38 percent of the length of the rails from one end of the rails and with the second pair of legs fastened to the rails at a distance of between 5 and 38 percent of the length of the rails from the other end of the rails.

7. The dryer as in claim 6: with the screen hanging down 66 percent of the distance from the top to the bottom of the legs with the dryer in the stored position and having a radius of 4 percent of that distance.

8. The dryer as in claim 6: with the dryer in the in-use position, each pivot located between one-half and three times the leg diameter above a plane surface the dryer rests on and the legs bent so that the screen is flat.

9. The dryer as in claim 6: with the ends of the legs fastened to the rails acting as tops of the legs and further comprising:

two resilient bands; one band fastened to the top of one leg of each pair and made to go around the top of the other leg of each pair with the dryer in the stored position, to hold the legs together.

10. The dryer as in claim 6: with the dryer in the in-use position and further comprising:

a first slat; made to fit between the two rails at one end;

a second slat; made to fit between the two rails at the other end, with both slats removable.

11. The dryer as in claim 6: with the screen having openings with all dimensions less than 5 cm.

* * * * *